United States Patent [19]

Kohus et al.

[11] Patent Number: 4,739,527

[45] Date of Patent: Apr. 26, 1988

[54] PORTABLE FOLDABLE PLAYPEN

[75] Inventors: Louis M. Kohus; Eugene L. Timperman, both of Cincinnati, Ohio

[73] Assignee: Sassy, Inc., Northbrook, Ill.

[21] Appl. No.: 883,073

[22] Filed: Jul. 8, 1986

[51] Int. Cl.[4] ..... A47C 29/00

[52] U.S. Cl. ..... 5/99 R; 5/99 A; 5/99 C

[58] Field of Search ..... 5/93 R, 98 R, 99 R, 5/99 A, 99 C, 493

[56] References Cited

U.S. PATENT DOCUMENTS

| | | | |
|---|---|---|---|
| 1,374,333 | 4/1921 | Stotler et al. | 5/99 R |
| 2,233,864 | 3/1941 | Edson | 5/493 |
| 2,523,422 | 9/1950 | Dunn | 5/99 C |
| 2,574,079 | 11/1951 | White | 5/99 C |
| 3,165,760 | 1/1965 | Abajian | 5/99 R |
| 4,008,499 | 2/1977 | Wren, Jr. et al. | 5/99 C |
| 4,202,065 | 5/1980 | Sullivan | 5/99 A |
| 4,538,309 | 9/1985 | Gunter | 5/99 A |

FOREIGN PATENT DOCUMENTS

| | | | |
|---|---|---|---|
| 952496 | 8/1974 | Canada | 5/99 R |
| 1063734 | 5/1954 | France | 5/93 R |

*Primary Examiner*—Alexander Grosz
*Assistant Examiner*—Michael F. Trettel
*Attorney, Agent, or Firm*—Dressler, Goldsmith, Shore, Sutker & Milnamow, Ltd.

[57] ABSTRACT

A portable foldable playpen assembly comprising a foldable frame assembly and an enclosure. The foldable frame assembly includes a central hub, at least four support legs spaced outwardly of the hub, and a linkage assembly hingedly connected to the central hub and to the legs. The linkage assembly is adapted to maintain the legs in a first expanded spaced array in which they are upright and generally parallel and widely spaced from the central hub and to permit movement of the legs into a second contracted compact array in which the legs are much closer to the central hub and to each other for transport. The enclosure is secured to the support legs and may include a depending skirt at the base of the enclosure.

17 Claims, 8 Drawing Sheets

PORTABLE FOLDABLE PLAYPEN

BACKGROUND OF THE INVENTION

This invention relates to an improved portable foldable playpen for children.

A wide variety of playpens have been designed and suggested for use in the past. Many such playpens have been collapsible and of the knock-down type. These have included playpens with various types of frame assemblies, as well as with various types of enclosures, such as fabric enclosures.

Thus, for example, U.S. Pat. No. 2,590,315 discloses a fabric enclosure which may be suspended from the legs of an inverted ordinary card table by fabric pockets which are closed at the top and open at the bottom. U.S. Pat. No. 4,538,309 discloses a knock-down portable playpen having a removeable fabric enclosure like that of U.S. Pat. No. 2,590,315, but with a frame assembly which has telescopically connected parts which may be assembled and disassembled and packed for transport.

U.S. Pat. No. 2,464,866 describes a playpen which may be folded into a carrying case-like arrangement after disassembly of the frame structure. U.S. Pat. No. 2,784,420 describes another knock-down playpen which has a frame made of disassembleable parts and to which a canvas enclosure may be attached. U.S. Pat. No. 2,491,036 similarly discloses a playpen having sidewalls of tubular frame members which may be separated for transportation together with a flexible netting enclosure which may be secured with the assembled frame members.

Patents such as U.S. Pat. Nos. 4,538,309 and 3,165,760 describe disassembleable playpen and crib arrangements in which the respective frames may be disassembled, and to which enclosures may be attached, with the floor of the enclosure spaced above a floor upon which the playpen is supported. French Pat. No. 1,557,841 discloses a foldable playpen having a foldable frame and an attached enclosure of fabric, and German Pat. No. 481,037 discloses a child's playpen which is foldable as shown in FIGS. 1-3 thereof.

Although some of the playpens referred to are foldable, when they are folded they are generally of a size which is at least as large as one of the sides of the playpen or one of the floor sections of the playpen. Of those which are disassembleable, they usually require disassembly into a plurality of frame elements which must later be reassembled, and the enclosure thereafter attached.

It would be of advantage to provide a much more compact folded assembly than the prior art suggests or discloses, and one which does not require disassembly or reassembly of the frame or reattachment of the enclosure to the frame when the playpen is unfolded after transport. It would also be of advantage to provide an improved frame assembly and an improved enclosure for a children's playpen.

SUMMARY OF THE INVENTION

In accordance with the present invention, an improved portable foldable playpen assembly is disclosed. The playpen comprises a foldable frame assembly and an enclosure. The foldable frame assembly comprises a central hub, at least four support legs spaced outwardly of the central hub, and linkage means hingedly connected to the central hub and to the legs. The linkage means are adapted to maintain the legs in a first expanded spaced array in which they are upright and generally parallel and widely spaced from the central hub, and to permit movement of the legs into a second contracted compact array in which the legs are much closer to the central hub and to each other. Means on the enclosure are provided for securing the enclosure to the support legs.

Desirably the linkage means includes releasable lock means for locking the support legs in the widely spaced array and for permitting the support legs to be unlocked for movement of the legs into the contracted compact array. The linkage means are positioned beneath the enclosure, and include an arm hingedly secured to each leg and to the central hub and for permitting movement of the legs into the compact array, with the legs preferably being generally in an upright parallel relationship when they are in the compact array.

The linkage means further preferably includes a link hingedly connecting an arm to a leg, the link being mounted for sliding movement along the leg. In a preferred form, a slide for movement along the leg is provided, the link is hingedly connected to the slide, and there are locking means on the slide for releasably locking the support legs in the widely spaced, upright array and for permitting the support legs to be unlocked for movement of the legs into the contracted compact array. The support legs may have feet, and means on the feet for releasably engaging the locking means for locking the support legs in the widely spaced upright array.

Most preferably the linkage means include a hinge fixedly secured to each leg for connecting an arm to an associated leg, and the slide is slideable along the leg between a foot of the leg and the hinge.

In another aspect of the invention, the portable collapsible playpen assembly comprises a frame assembly comprising at least four generally vertically disposed support legs, and means for retaining the support legs in a predetermined spaced array, with the support legs having upper ends and foot portions for supporting the legs on a support surface. The playpen further comprises an enclosure having a sidewall and a floor and pocket means for suspending the enclosure on the upper ends of the legs, with the floor spaced well above the foot portions. Skirt means depending from the floor are provided and the skirt means extend between the floor and the foot portions for enclosing the space below the floor and for preventing entry below the enclosure when the foot portions are supported on a support surface. Preferably the skirt means comprises skirt panels secured with the sidewall and which are also securable to the foot portions.

Further objects, features and advantages of the present invention will become apparent from the following description and drawings.

DESCRIPTION OF THE PRESENTLY PREFERRED EMBODIMENTS

Figure 1:
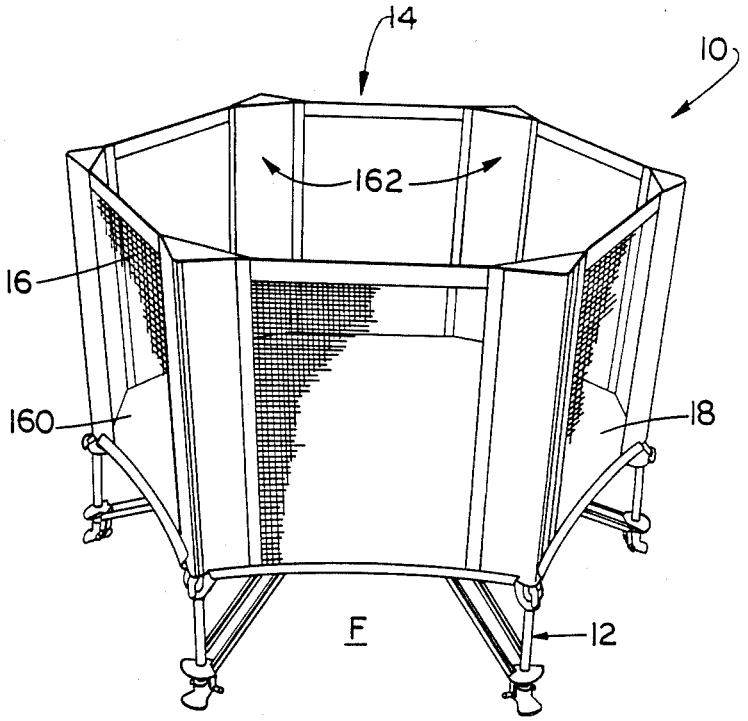
FIG. 1 is a perspective view of a portable, foldable playpen in accordance with the present invention.
Figure 2:
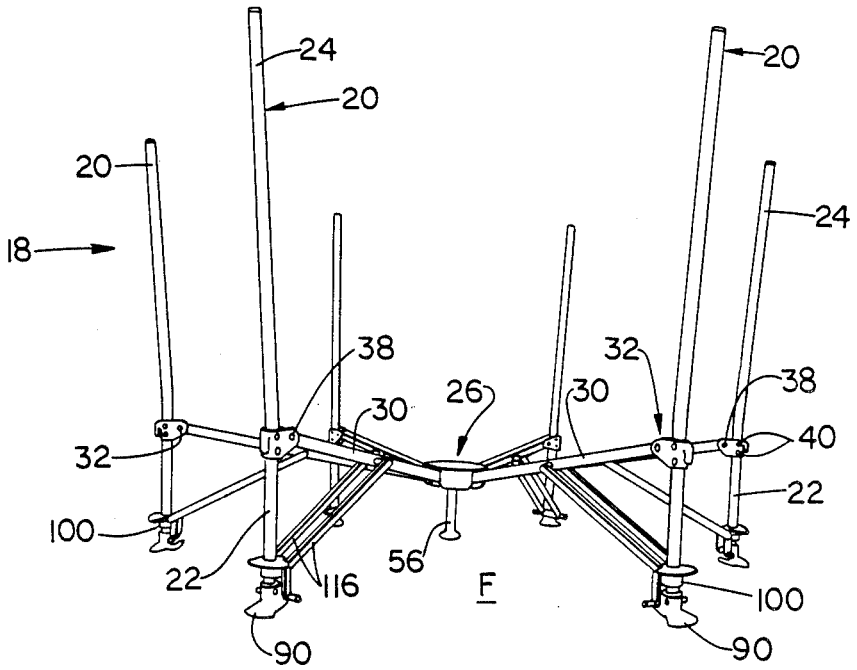
FIG. 2 is a perspective view of the frame assembly of the playpen of FIG. 1.

Referring now to the drawings and first to FIGS. 1 and 2, a portable foldable playpen 10 of the present invention includes a frame assembly 12 and an enclosure 14, preferably of fabric, having a sidewall 16 and a floor 18.

Figures 3, 4, 5, 6, 7:
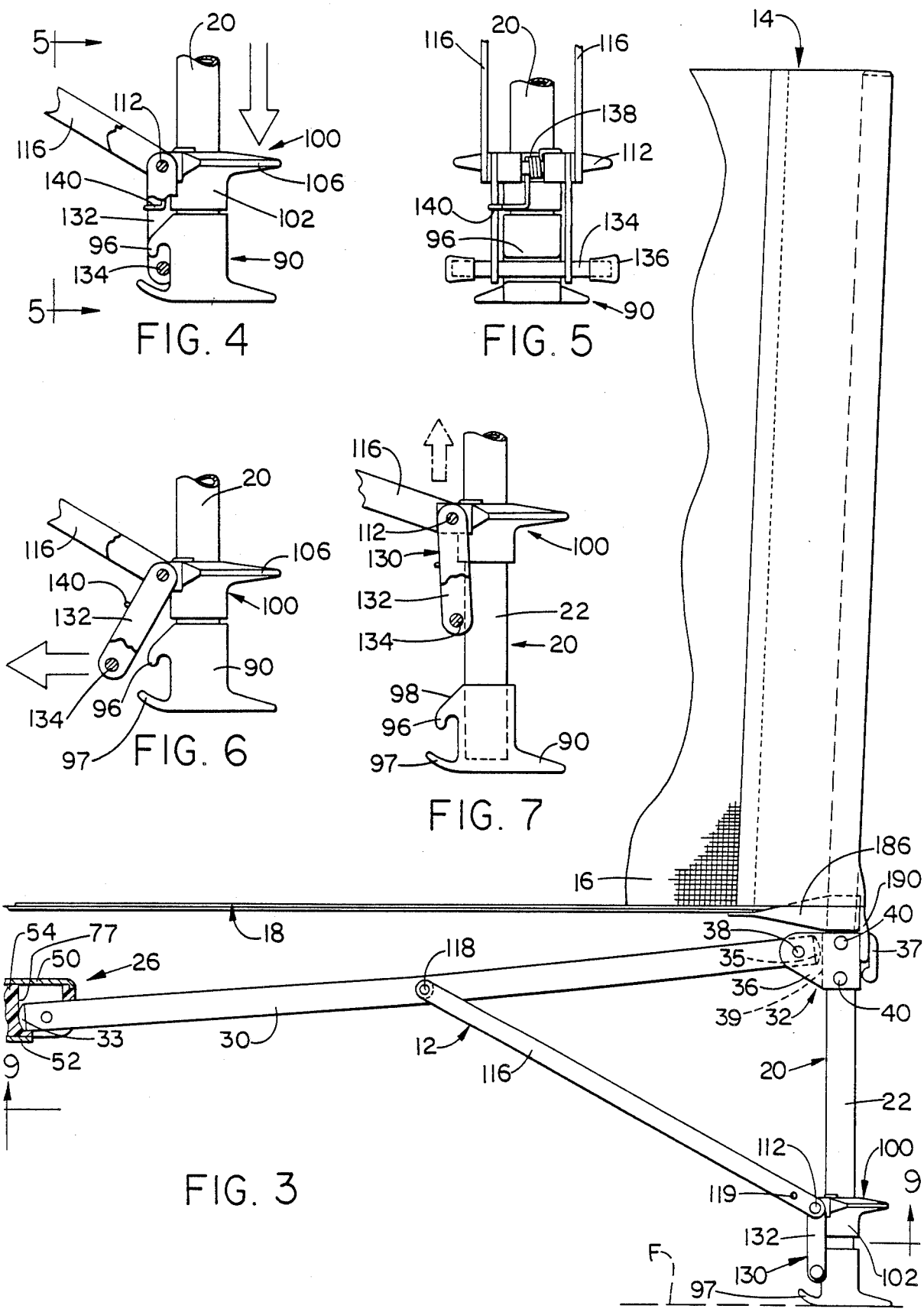
FIG. 3 is an enlarged, fragmentary side elevational view of the playpen of FIG. 1.
FIG. 4 is an enlarged portion of FIG. 3 showing the commencement of the folding procedure for the playpen frame assembly.
FIG. 5 is a side elevational view taken along line 5—5 of FIG. 4.
FIG. 6 is a view similar to FIG. 4 showing a lock assembly in a partially unlocked condition.
FIG. 7 is a view similar to FIG. 6, but showing the playpen frame assembly during the folding procedure.
Figure 8:
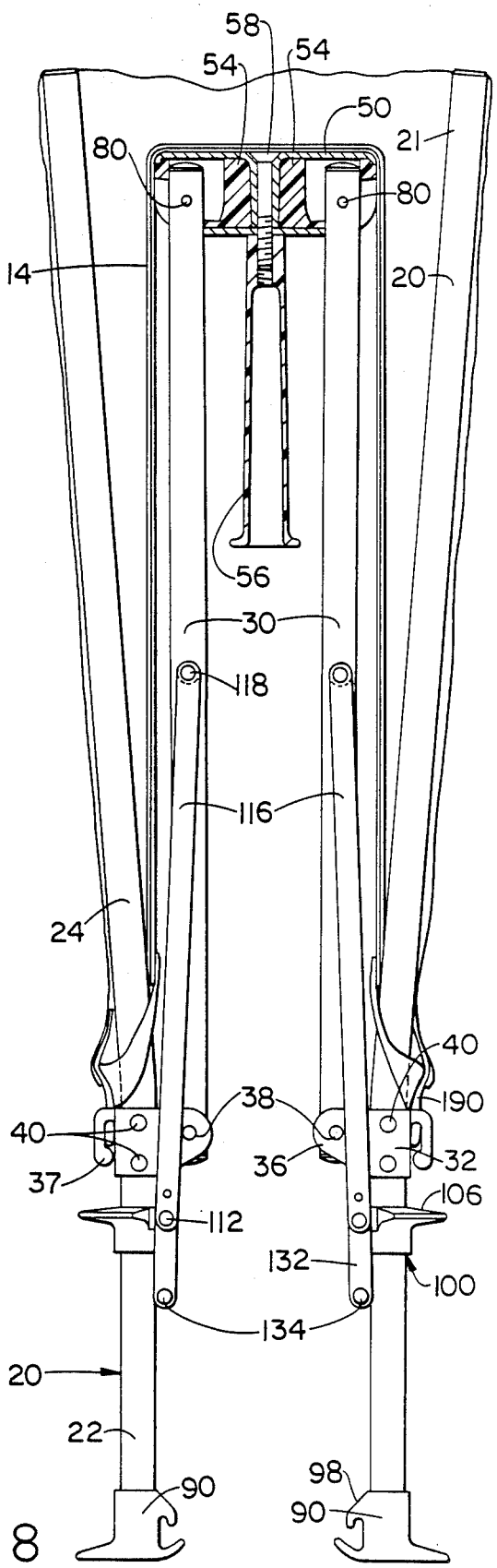
FIG. 8 shows a playpen of FIG. 1 in a compact folded condition.

The frame assembly 12 includes a plurality of support legs 20 and is adapted to be folded, generally from the widely spaced position of use shown in FIGS. 2 and 3 to the contracted collapsed position shown in FIG. 8. In the embodiment of FIGS. 1 and 2, the frame and enclosure are designed to provide a hexagonal or six-sided playpen configuration. Although more or less sides may be provided, it is preferred that at least four sides be provided.

The frame assembly 12 comprises six support legs 20, each having a generally vertical lower leg segment 22 and an upper integral outwardly bent leg segment 24. Preferably the legs are of round tubular stock, and may be aluminum.

Figure 24:
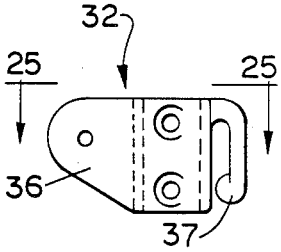
FIG. 24 is a side elevational view of a hinge and associated strap retainer portion of the frame assembly.
Figure 15:
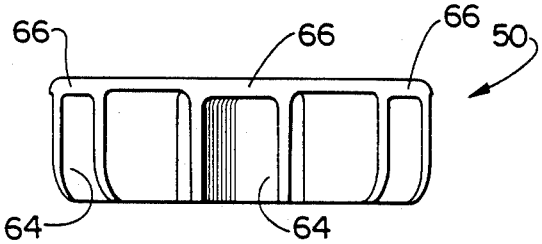
FIG. 15 is a side view of the hub of FIG. 13 taken substantially along the line 15—15 of FIG. 13.
Figure 19:
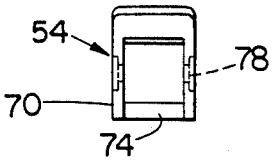
FIG. 19 is a side elevational view of the hub wedge of FIG. 16 taken substantially along the line 19—19 of FIG. 16.
Figure 25:
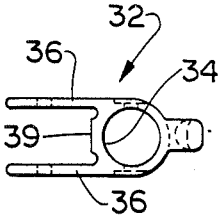
FIG. 25 is a plan view of FIG. 24 taken substantially along the line 25—25 of FIG. 24.

The legs 20 are hingedly connected with a central hub assembly 26 via a linkage means including radial arms 30. Radial arms 30 are tubular, and preferably square. A radial arm is hingedly fixed to an associated leg 20 via a hinge 32. As may best be seen in FIGS. 24 and 25, hinges 32 each define a tubular opening 34 for receiving a leg 20. Hinge 32 further defines a yoke comprising a pair of arms 36 for receiving one end of a radial arm 30. Radial arm 30 is secured to the hinge arms 36 by a rivet or other pivot pin 38 and the hinge 32 is fixedly secured in a fixed vertical position relative to leg 20 by a pair of rivets 40 (see FIG. 2).

The other end of radial arm 30 is hingedly secured to the hub assembly 26 in a manner to be described hereafter.

Hub assembly 26, as best seen from FIGS. 2, 8, 9, 10 and 13-19, comprises a central hub section 50, a hub plate 52, a series of hub wedges 54 and a support foot 56. Support foot 56 is preferably secured, as by a threaded bolt 58, to the central hub assembly. As best seen in FIG. 2, the support foot 56 is intended to rest upon the floor F upon which the playpen is to be supported to provide central support for the frame assembly 12. Lower hub plate 52 which defines a central opening through which the bolt 58 may pass, as best seen in FIG. 8, is secured to the central hub section 50 by a series of threaded fasteners 60 (FIG. 9) which are threadedly received within complimentary openings 62 (see FIG. 13) in central hub section 50.

Central hub section 50 may be of a suitable plastic or cast metal. The hub plate 52 may be of sheet steel or the like. The hub wedges 54 are preferably formed of plastic, such as of a suitable nylon or polypropylene. As seen in FIG. 8, each hub wedge 54 is received and retained within a socket or pocket 64 (FIG. 13) defined by the central hub section 50. The hub wedges are retained by hub plate 52 at the bottom and are restrained against outward or lateral movement by the depending perimeter lips 66 formed integrally with the central hub section 50.

As seen in FIG. 3, the end of radial arm 30 remote from the hinge 32 is capped with a plug 33 and received within a hub wedge 54 (see FIGS. 16–19). Hub wedge 54 defines a pair of sidewalls 70, a wedge shaped forward end 72, a lower shelf 74 and an upper bridge 76. The wedge shaped forward end bears against a complementary hub surface. The sidewalls define openings 78 which are intended to receive a pivot pin 80 (see FIG. 8) which passes through the end of the radial arm 30 and through the openings 78, thereby to pivotally support and hingedly connect the end of the arm 30 on the hub assembly 26.

When the radial arm 30 is moved to the position illustrated by FIG. 3 i.e., when the playpen is fully erect, the inner bearing surface or end of arm 30 provided by plug 33 bears against a wedge bearing surface 77 so that the compressive force of the arm is transferred to the wedge and hub 50, and is not borne by the pivot pin 80. Also the shelf 74 and bridge 76 limit movement of the arm 30 and eliminate vertical load on pivot pin 80. Similarly, the other end of the arm 30 is provided with a plug 35 which slides into contact with and bears against the inner surface 39 of the hinge between hinge arms 36 so that the compressive load is against the hinge 32 and leg 20, not against pivot pin 38.

Figure 20:
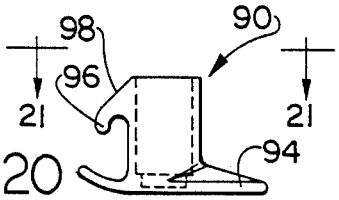
FIG. 20 is a side elevational view of a foot portion of the frame assembly.
Figure 21:
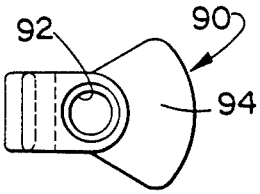
FIG. 21 is a plan view of the foot of FIG. 20 taken substantially along line 21—21 of FIG. 20.

As best seen in FIGS. 3, 20 and 21, each leg 20 is provided with a support foot 90. Support foot 90 may be molded of a suitable plastic and defines a central opening 92 for receiving the end of a leg, and includes an expansive extended support pad 94 which is adapted to rest on the floor F upon which the foldable playpen is supported. Foot 90 further includes a hook 96 for a purpose to be described.

Foot 90 also includes an upwardly inclined foot pad segment 97. It will be apparent that as a leg 20 is collapsed from the position of FIG. 3, the foot will move outwardly along the support surface, such as floor F. The pad segment 97 will smoothly slide along a rug surface or the like, to a collapsed position, as typified by FIG. 7B. Similarly when the frame assembly is moved from the position of FIG. 8 to outwardly splayed positions, as, for example, illustrated by FIG. 7C, the foot will similarly slide on pad segment 97. Also, as the leg is moved from the outwardly splayed position into the upright position of FIG. 3, the segment 97 will facilitate smooth movement along a floor surface.

Figure 23:
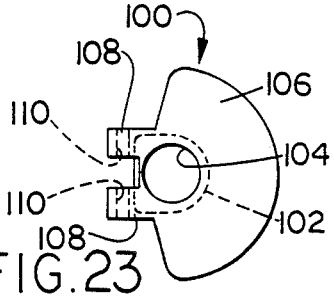
FIG. 23 is a plan view taken substantially along line 23—23 of FIG. 22.
Figure 22:
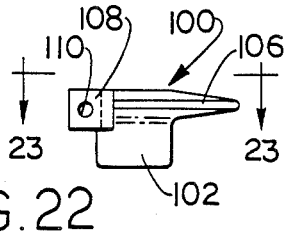
FIG. 22 is a side elevational view of a slide portion of the frame assembly.

Each leg 20 is also provided with a slide 100 which is mounted for movement along the leg from the position typically shown by FIG. 3 through the positions represented by FIGS. 4–7, and finally to the position of FIG. 8. As shown by the drawings, including FIGS. 22 and 23, slide 100 includes a central apertured hub 102 which defines an opening 104. Opening 104 is complimentary to, and slideable along, lower leg segment 22 from adjacent the foot 90 (FIGS. 3 and 4) to adjacent the hinge 32 (FIGS. 7 and 8).

Slide 100 also defines a generally fan-shaped projection 106 at one side and a yoke comprising a pair of arms 108 at the other side. Arms 108 define aligned openings 110 which are adapted to receive a pivot pin 112 (FIG. 3). Pivot pin 112 supports a pair of links, such as strap-like braces 116, as of steel or aluminum. The other ends of the braces 116 are pivotally secured to the radial arm 30 by a further pivot pin 118 which extends through the braces and through an aligned opening in the radial arm 30 (see FIGS. 3 and 9). In that manner, the braces 116 are adapted to pivot relative to the radial arm 30 as will be described.

Pivot pin 112 also pivotally mounts a lock assembly 130. Lock assembly 130 comprises a pair of links 132 which are pivotally mounted at one end on pivot pin 112 and which are press fit at their other ends on a lock pin or release foot 134. Release foot 134 comprises portions which extend laterally beyond the links 132 (see FIG. 5) and which may preferably be covered, as with rubber caps 136. A torsion spring 138 (FIG. 5) is mounted on pivot pin 112, and includes an arm 140 which biases the links 132 and the associated release foot 134 into the position illustrated by FIGS. 3 and 7.

To lock the braces 116 in the position generally illustrated by FIG. 3, i.e., the down position, the release foot 134 is positioned under foot hook 96 and is allowed to remain in the notch defined by the hook 96. When it is desired to collapse or fold the frame assembly 12, the slide 110 is pushed down from the position of FIG. 3 to the position shown in FIGS. 4 and 5, i.e., with the release foot 134 moved downwardly below the hook 96. The release foot 134 is then moved forwardly, as shown by FIG. 6, and the slide 100 is then moved upwardly, such as to the position of FIG. 7. At that time, the torsion spring 138 biases the lock assembly 130 about the pivot pin 112 to the position illustrated in FIG. 7, and to that of FIG. 8.

Of course, when the frame assembly is to be set up, the slide 110 will be moved downwardly to about the position of FIG. 7, will continue downwardly, will be cammed out by the confronting cam surface 98 of the foot 90, until the release foot reaches, and is biased into a position, such as the position typified by FIG. 4. When the slide 100 is then allowed to move slightly upwardly, the release foot 134 will be captured by the foot hook 96 to retain the leg and frame assembly in the locked position as illustrated by FIGS. 2 and 3.

Referring now to the enclosure 14 (see FIG. 1), the sidewall 16 will be seen to comprise a series of six side panels 160. Side panels 160 are preferably formed of a known nylon mesh material and may be formed unitarily, being connected at one end to form a continuous sidewall 16. At each of the corners of the sidewall, an inner protective panel 162 is provided. Protective panel 162 may be of a more tightly woven fabric as of nylon, and is suitably stitched to the side panels 160.

Figure 26:
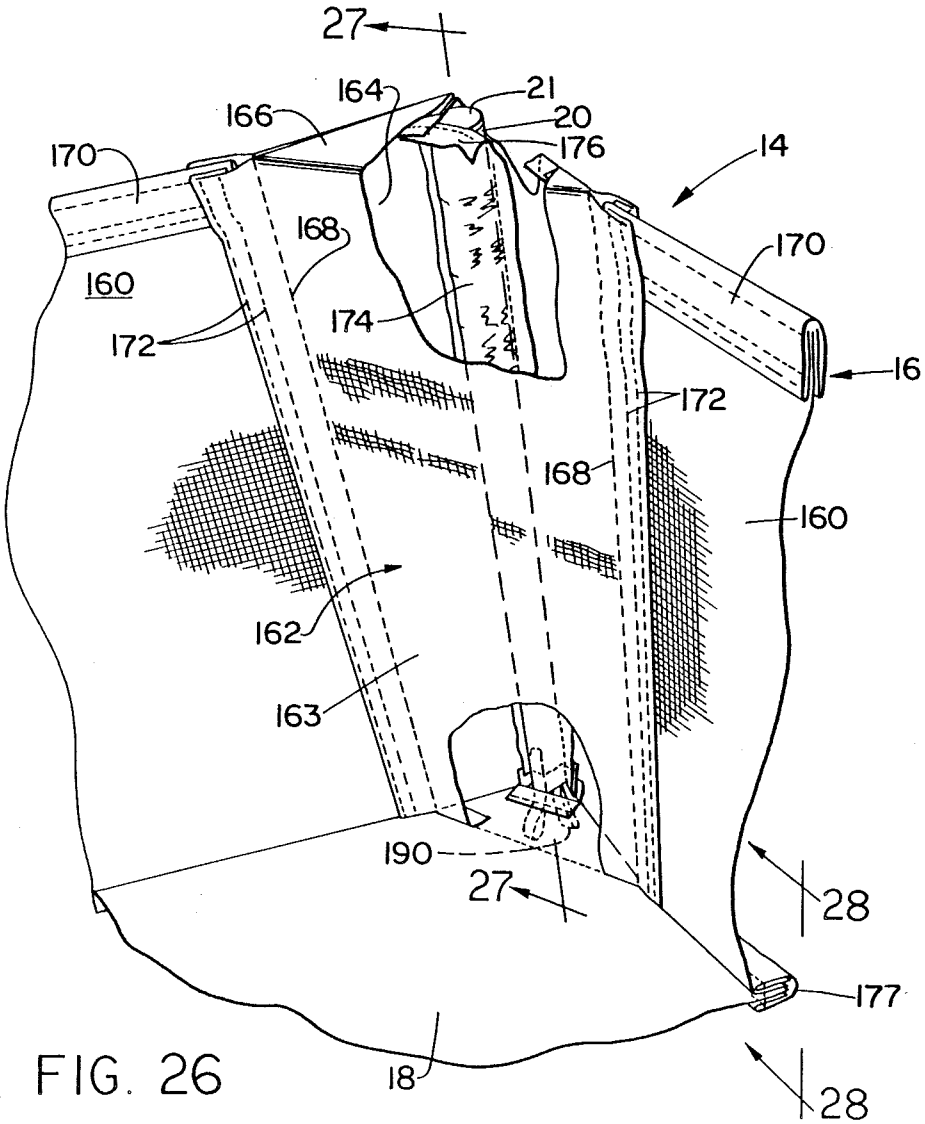
FIG. 26 is a fragmentary perspective view, partially cut-away, of an enclosure portion of the playpen of FIG. 1.

The protective panel 162 more particularly shown in FIG. 26 is one which is of a double layer of fabric, one of which forms an inner protective panel portion 163 internally of the playpen and internally of the legs 20 and a second somewhat wider outside layer 164. Portion 163 is formed with a cap section 166. Together, all of these thereby to provide an enclosure for the leg 20. As best seen in FIG. 26, the protective panel portion 163 and back panel 164 which is a continuation of the side panels of sidewall 16 are stitched together along their side edges along a line of stitching 168.

Also as seen in FIG. 26, the upper edges of the side panels 160 are each provided with a fabric or plastic binder 170 which is suitably stitched thereto. During fabrication, the side panels 160, with the binder 170, are stitched along lines of stitching 172 to the protective panel 162 thereby to provide pocket-like corners for the enclosure 14 which, with cap section 166, also overlies the top 21 of the leg 20. Top 21 may have an inserted cap or the like to finish the cut upper edge of the tubular stock from which leg 20 is made.

Although the cap section 166 may serve to support the enclosure on the legs 20, as shown in FIG. 26 a supplemental protective fabric cover 174 having a covering cap portion 176 may also be present to provide for additional support of the enclosure 14 on the leg 20 of frame assembly 12. The upper end of the cover 174 is sewn to the upper end of back panel 164 at the inside of leg 20. The outer edge of cap section 166 is sewn to the upper portion of panel 164 at the outside of the leg.

Figure 28:
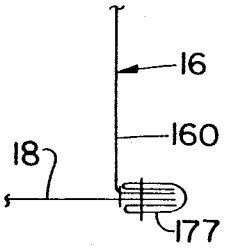
FIG. 28 is a schematic partial sectional view of the enclosure of FIG. 26 taken generally in the direction of line 28—28 of FIG. 26.
Figure 27:
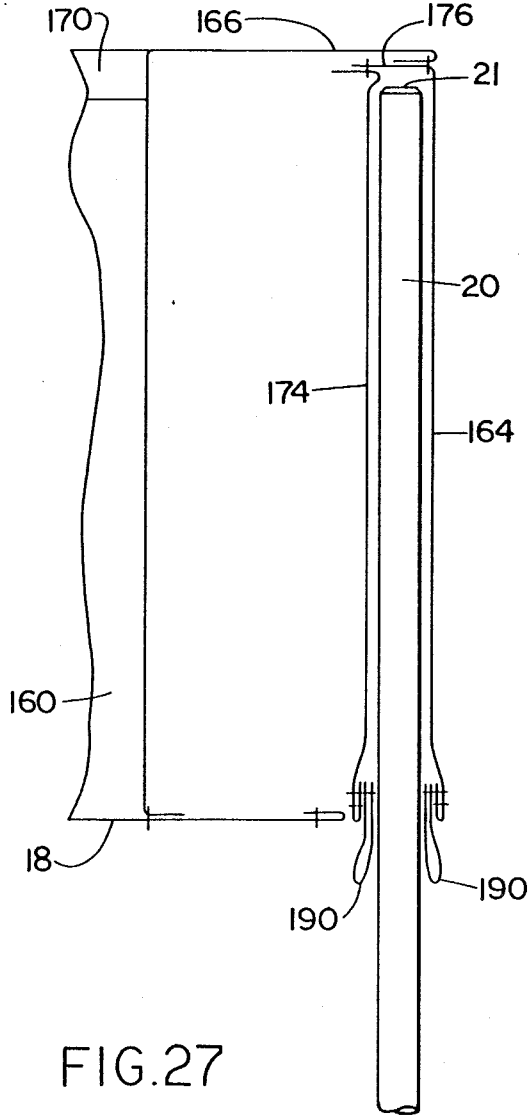
FIG. 27 is a schematic view of a portion of the fabric assembly of FIG. 26 taken generally in the direction of line 27—27 of FIG. 26.

As shown in FIGS. 26, 27 and 28, the protective panel 162, including the protective panel portion 163, back panel 164 and protective fabric cover 174 terminate adjacent the floor 18 of the enclosure 14. As seen in FIGS. 26, 27 and 28, they and the sidewall 16, including sidewall panels 160, are stitched to the floor, preferably with a suitable binding 177, thereby securely to anchor the floor to the side panels 160 to form an integrated enclosure 14 with six corner pockets.

Figures 10, 11, 12:
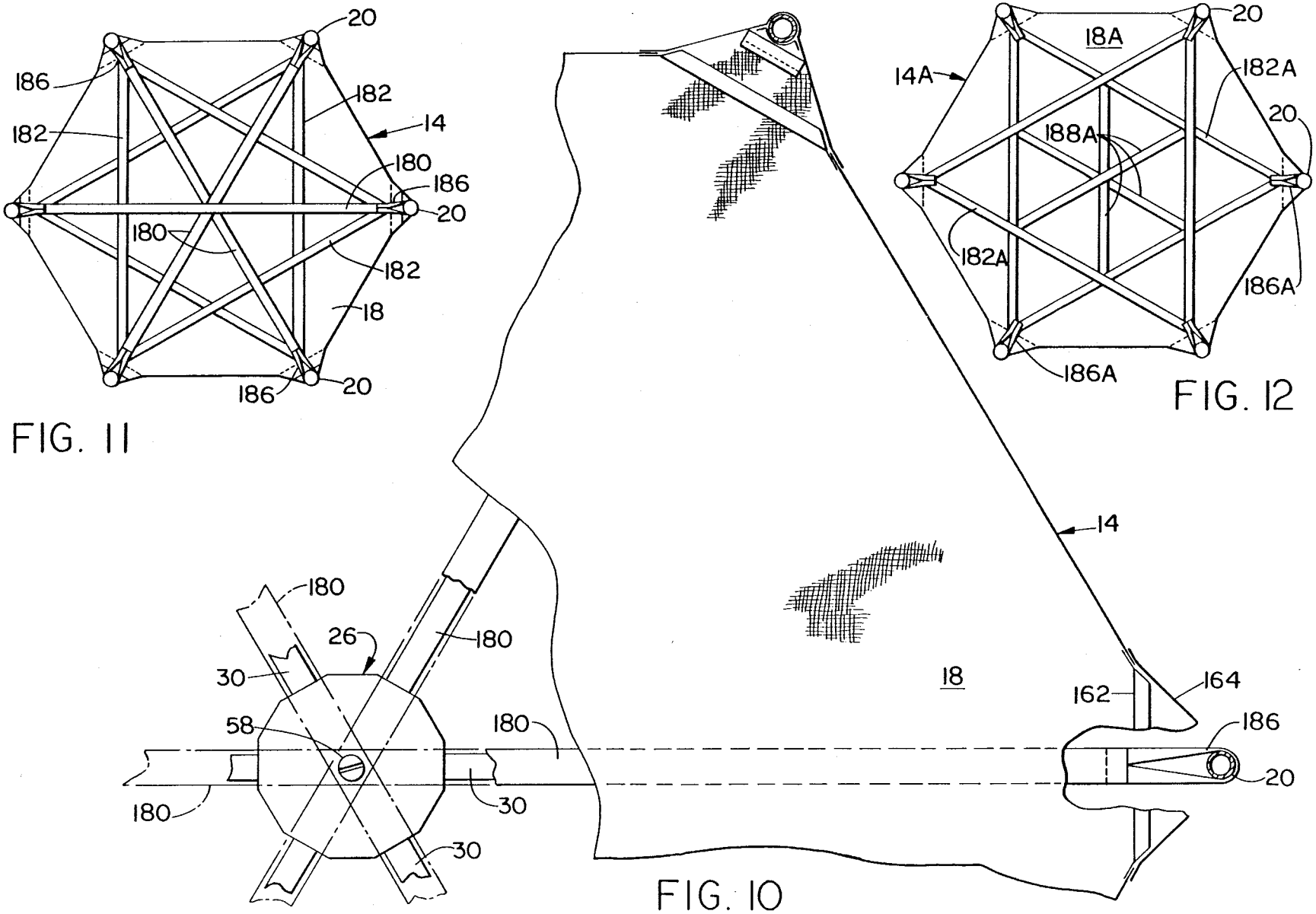
FIG. 10 is a partial plan view of the playpen of FIG. 1, partially broken away and partially in section.
FIG. 11 is a bottom view of the playpen of FIG. 1 showing an enclosure floor support strapping arrangement.
FIG. 12 is a bottom view similar to that of FIG. 11 showing an alternative enclosure floor support strapping arrangement.
Figure 14:
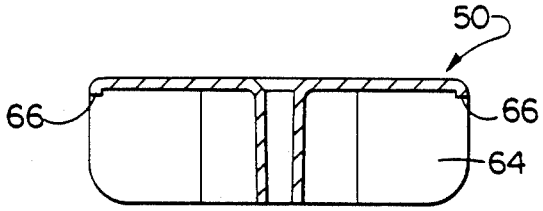
FIG. 14 is a cross-sectional view taken substantially along line 14—14 of FIG. 13.
Figure 17:
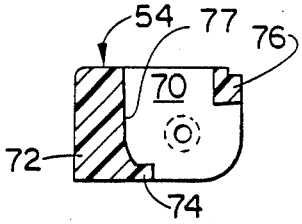
FIG. 17 is a cross-sectional view of a hub wedge taken substantially along line 17—17 of FIG. 18.
Figure 16:
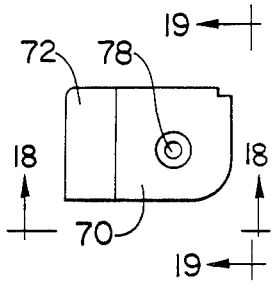
FIG. 16 is a side elevational view of a hub wedge portion of the frame assembly.
Figure 13:
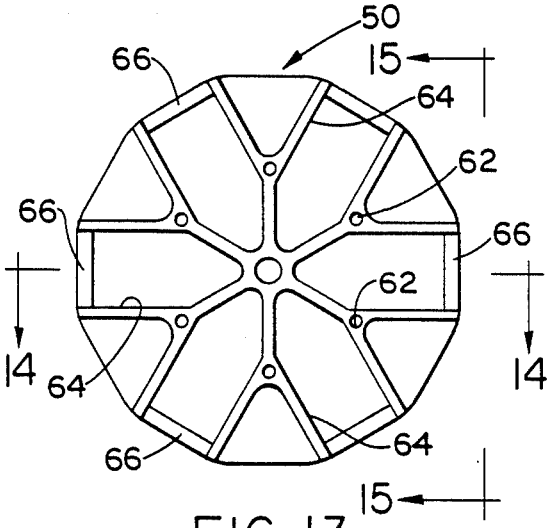
FIG. 13 is a bottom view of a hub portion of the playpen frame assembly.
Figure 18:
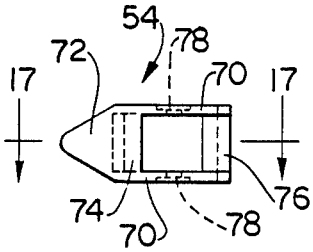
FIG. 18 is a bottom view of the hub wedge of FIG. 16 taken substantially along the line 18—18 of FIG. 16.

To rigidify and strengthen the floor 18, a generally non-stretchable, tensioning strapping which is stitched to the floor 18 is provided. As shown in FIG. 11, a plurality of diametric straps 180 are provided. These straps 180 extend between opposite legs 20. In addition, where desired, a plurality of chordal straps 182 are provided, the straps 180 and 182 forming a generally spider-like pattern to provide a more rigid, non-stretchable floor 18. Chordal straps 182 extend between legs 20 which are not directly opposite each other. The ends of the diametric straps are provided with loops 186 which are proportioned and positioned to slide over the legs 20 thereby to anchor the floor 18 of the enclosure 14 to the legs 20 and to place the diametric straps in tension, thereby to tension the floor 18 to minimize sagging.

An alternative spider-like arrangement is illustrated in FIG. 12 where the strapping comprises a plurality of chordal straps 182A, each of which terminates adjacent a leg 20. Each chordal strap 182A provides a loop 186A to go around a leg 20 and to place the floor 18A of the enclosure 14A in tension. Additional strap segments 188A join the various chordal straps 182A to assist in rigidifying the floor 18A in the central area thereof.

To further anchor and strengthen the enclosure 14 in its supporting relationship to the frame assembly 12, the enclosure 14 is provided with fabric anchoring loops 190. The outside loops 190, as best seen in FIGS. 3, 8, 26 and 27, are engaged with hinge hooks 37 which are integrally formed with the hinges 32 and which are at the sides of the hinges 32 opposite the hinge arms 36. The outside anchoring loops 190 serve to maintain the sides of the enclosure in a fully opened vertical disposition and to prevent the floor 18 from riding upwardly along the legs 20. The inside and outside loops 190 also facilitate telescoping of the enclosure relative to the legs 20 during assembly of the enclosure with the frame assembly.

Figure 29:
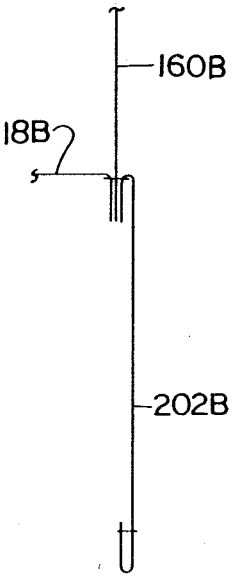
FIG. 29 is a schematic partial sectional view taken along line 29—29 of FIG. 30.
Figure 30:
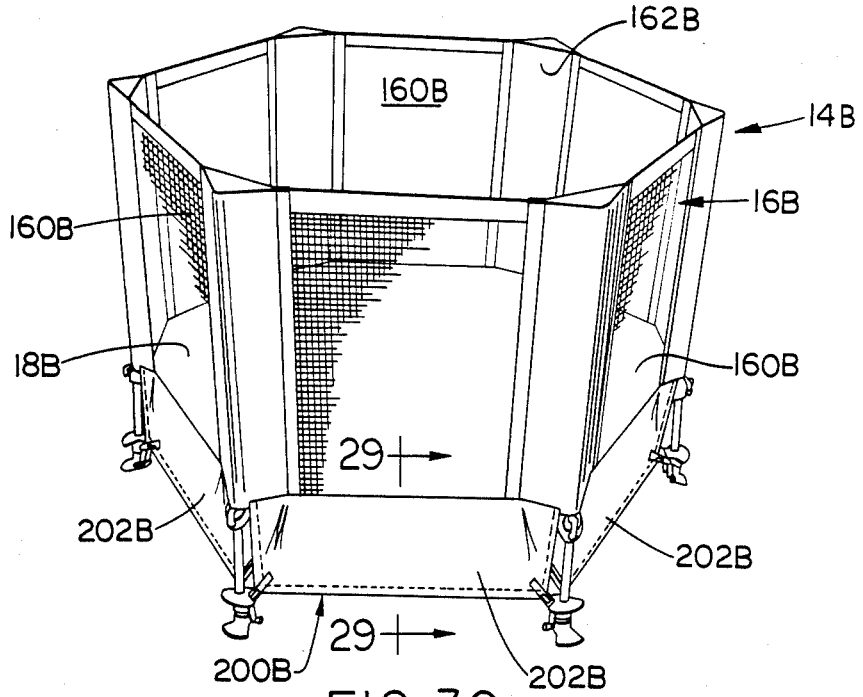
FIG. 30 is a perspective view of a playpen, similar to the playpen of FIG. 1, but having an attached skirt at the lower extremity of the enclosure.
Figure 31:
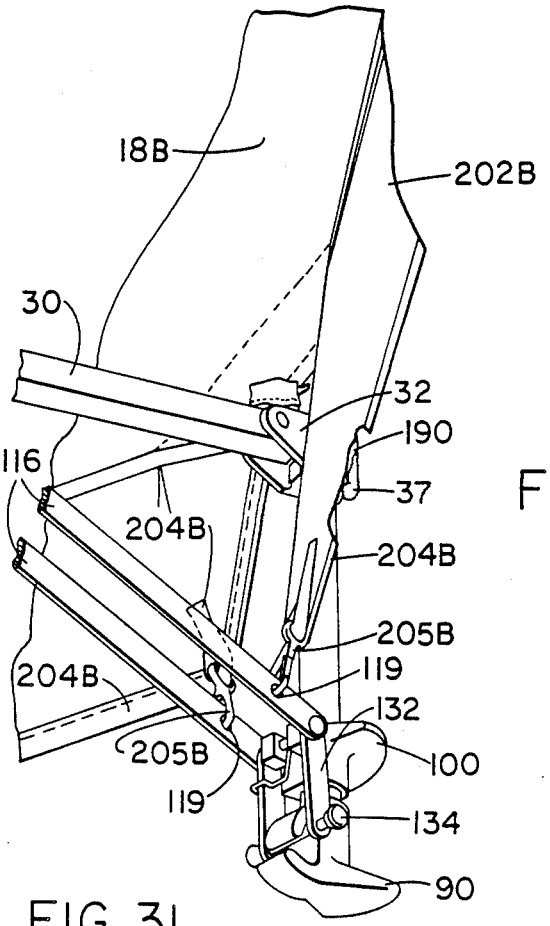
FIG. 31 is a bottom perspective view of a portion of the playpen of FIG. 30.

Referring now to FIGS. 29 to 31, a further enclosure 14B is illustrated. Enclosure 14B has the same sidewall 16B and side panels 160B as does the enclosure 14. Similarly, the floor 18B is the same, as are the protective panel 162B and other features. However, the enclosure 14B defines a skirt 200B which includes a plurality of depending skirt members 202B, one for each side panel 160B, the side panels 160B being joined with the enclosure floor 18B and with skirt panels 202B as illustrated schematically in FIG. 29.

Each lower corner of the skirt panel 202B is provided with a loop 204B and typically a hook 205B which may engage opening 119 in the brace 116 (see FIG. 31) or which is adapted to be hooked over the outer end of the release foot 134, thereby to anchor the skirt ends so that the skirt panels 202B are retained in a substantially tensioned condition, generally as illustrated in FIG. 30. The skirt 202B thereby encloses the space between the enclosure floor 18B, and preferably as close to the feet 90 as possible, thereby to minimize the possible entry of animals or young children beneath the floor 18B so that when the playpen is in use the possibility of injury will be minimized.

The operation of the frame assembly will now be described. For ease of description, the enclosure 14 will be ignored and will be discussed separately hereafter.

The playpen frame assembly as shown in FIG. 2 is adapted to be moved from the position shown in FIGS. 2 and 3 to that of FIG. 8 very quickly and very easily. Thus, as seen in FIGS. 1–3, the legs 20 are maintained in a first expanded spaced array in which they are upright and generally parallel and widely spaced from the central hub assembly 26. They are adapted to be moved into a second contracted compact array in which they are much closer to the central hub and to each other, and preferably in a generally vertical parallel array as shown in FIG. 8. To that end, serially, the releasable lock assembly 130 for the linkage assembly for retaining each leg 20 in the upright spaced array is released from the position shown in FIG. 3 to permit movement of the legs through the sequence of steps shown by FIGS. 4, 6, 7, 7A, 7B, and 7C into the contracted compact array of FIG. 8.

Figure 7A:
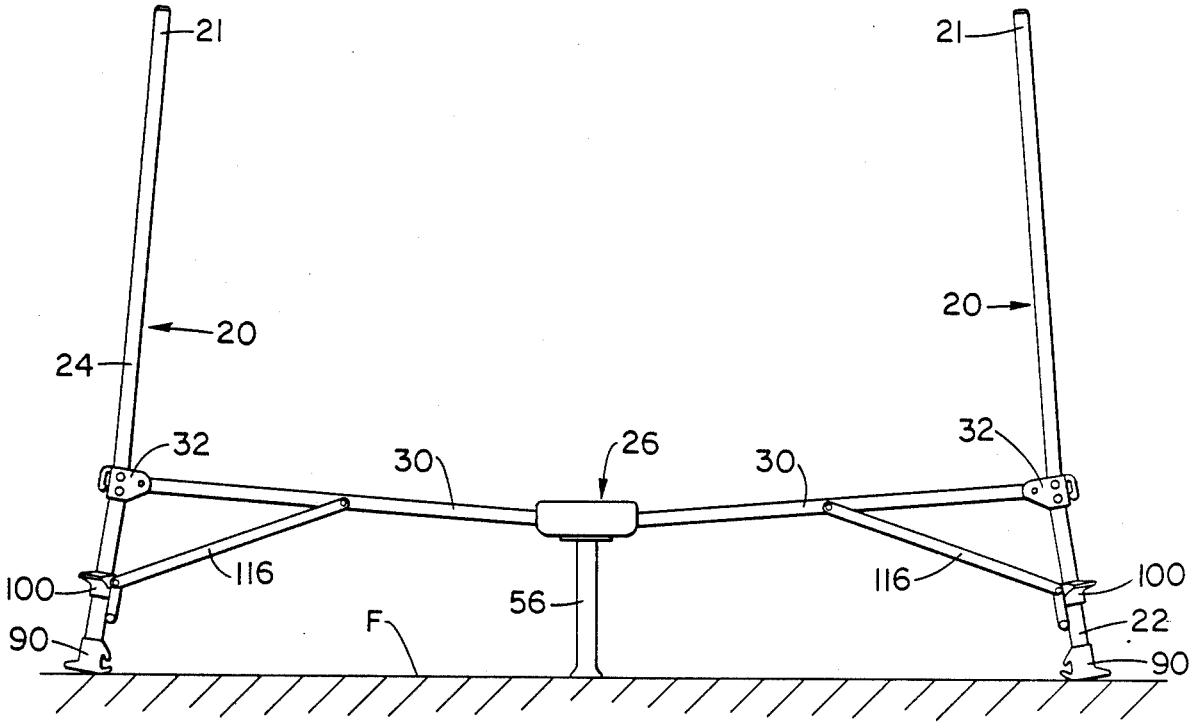
FIG. 7A is a view like FIG. 7, but of a pair of opposite legs in the pre-collapsed position of FIG. 7.
Figure 7B:
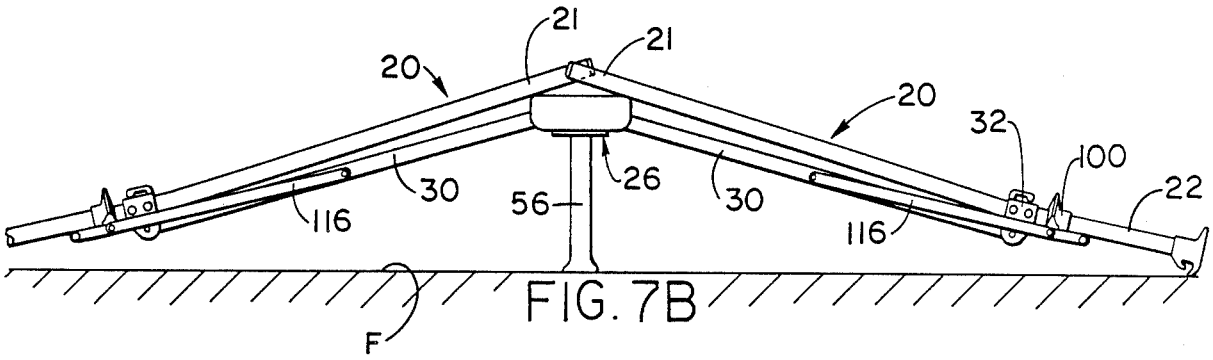
FIG. 7B is a view of the playpen frame of FIG. 7A further collapsed to a generally flat condition.
Figure 7C:
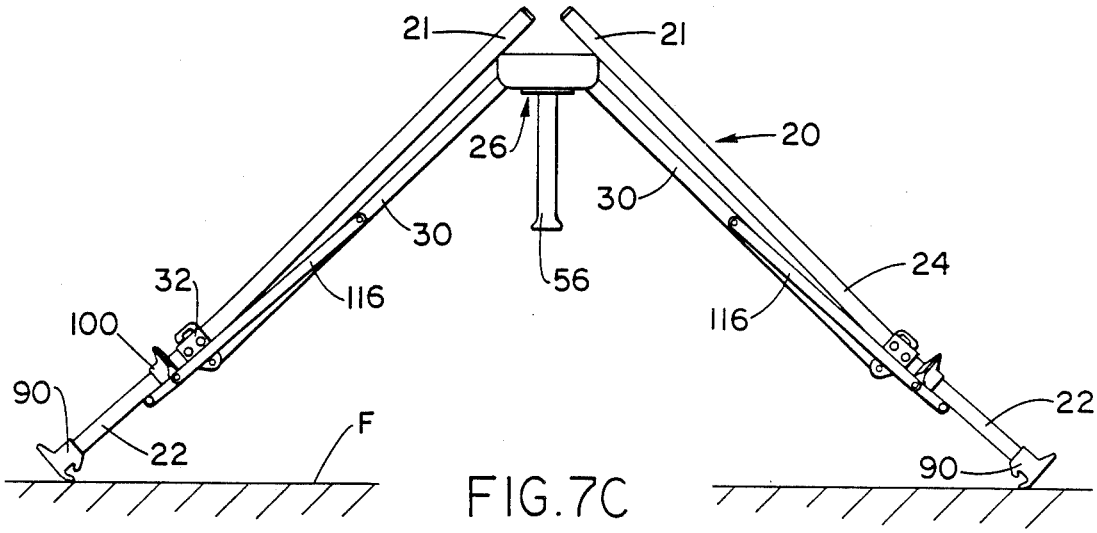
FIG. 7C is a view of the playpen frame of FIG. 7B in an intermediate position of movement to the compact folded condition.
Figure 9:
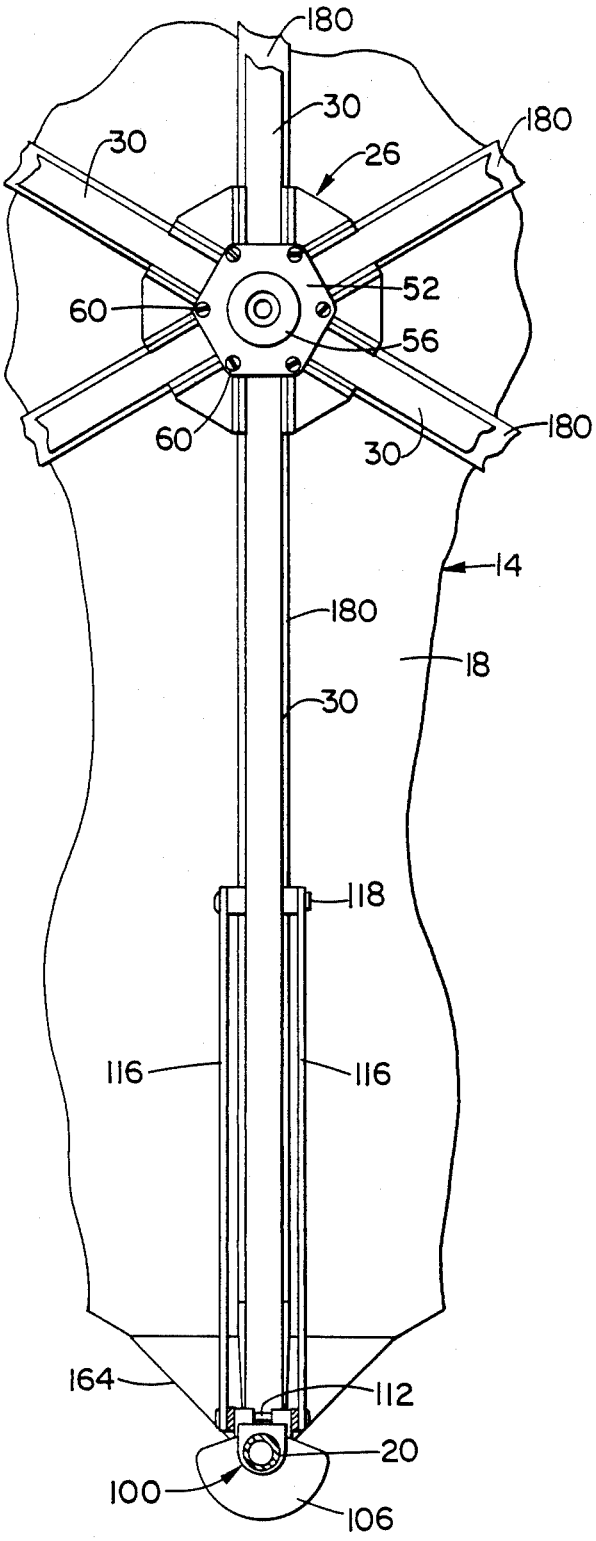
FIG. 9 is a bottom view, partially in section, taken substantially along the line 9—9 of FIG. 3.

After each lock assembly 130 has been released as shown by FIGS. 4 and 6, the lock assembly is elevated along leg 20 in the direction of the hinge 32 and contributes to facilitating the inward and downward movement of the upper end 21 of leg 30, i.e., the movement of the upper ends 21 towards the central hub assembly 26, as shown by FIGS. 7A and 7B. When each of the slides 100 has been moved substantially to the positions illustrated by FIG. 7B, with the upper ends 21 of the legs pushed downwardly towards the hub, generally as illustrated by FIG. 7B, the central hub 26 or support foot 56 may be gripped, and may then be pulled upwardly, drawing the lower segments 22 of the legs 20 adjacent the hinges 32 towards each other (as illustrated by FIG. 7C) into the compact, contracted array position of FIG. 8. In that position, as shown in FIG. 8, the entire frame assembly is quite compact and is easily transported.

Figure 32:
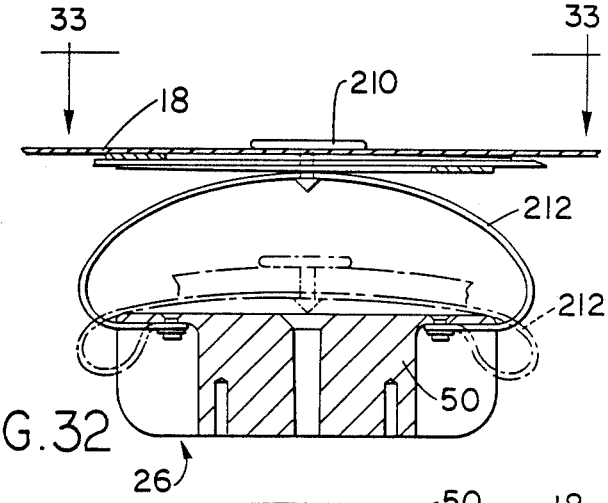
FIG. 32 is a fragmentary view of a central section of a playpen of FIG. 1 showing a modified central hub zone.
Figure 33:
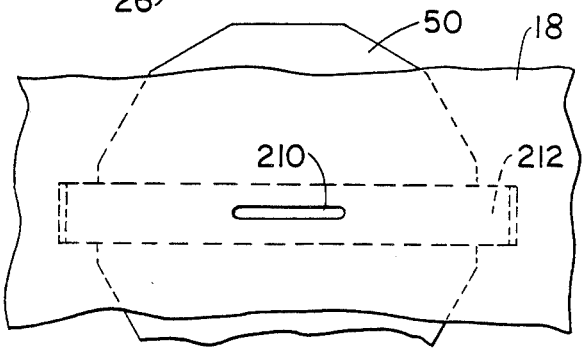
FIG. 33 is a fragmentary plan view taken along the line 33—33 of FIG. 32.

Although there are a variety of ways in which the generally flattened array of FIG. 7B may be moved into the compact array condition of FIG. 8, one convenient mode of so collapsing the flattened array is to provide a pull button 210 secured to the hub (see FIGS. 32 and 33). The pull button 210 may be anchored to a strap 212 which is secured to the hub 50. The pull button passes through the floor 18 of the enclosure and may be covered by a flap (not shown) which is open at the side to provide access to the button. When the pull button is pulled upwardly, and the lower ends 21 of the legs 20 are held down, the hub assembly 26 will be elevated from the position of FIG. 7B to that of FIG. 7C, eventually to that of FIG. 8.

The frame is foldable as described with the enclosure 14 assembled with it. Thus, during folding and unfolding, there are no special steps which need to be taken, either to remove or otherwise to specially deal with the enclosure 14.

When the folded playpen assembly 10 is intended to be set up for use from the compact contracted position represented by FIG. 8, the zone of the upper ends 21 of the legs are gripped and squeezed. This forces the feet outwardly somewhat, generally to a position between that of FIGS. 7C and 8. Then either hub 50 is pushed down further or the legs 20 are pulled out further causing the radial arms 30 to pivot outwardly about the pivot pins 80 in the hub and the arms to pivot about hinges 32. Once the arms 30 are generally in their fully extended position, the legs are then pushed or pulled fully up and out and the slides reach the zone of the associated feet 90. Each lock assembly 130 then is cammed downwardly along cam surface 98, is biased inwardly beneath hook 96, and then is held in the interlocked position typified by FIG. 3. After each of the six legs has been so positioned and moved to the expanded spaced array as shown in FIG. 2, the playpen will be fully set up. If for some reason they have become loosened or detached, it may thereafter be necessary to engage or reengage the anchoring loops 190 and/or skirt panel hooks 204B as described above.

As seen in the drawings, the upper portions 24 of legs 20 comprise outwardly bent segments 24. These are major segments of the legs which may extend generally from the hinges 32 upwardly. The principal purpose of the outwardly bent segments 24 is to produce a spring-like effect to keep the enclosure walls taut and the fabric of the enclosure straight and to manufacture the same of rectangular panel portions without tapers. Hence the overall playpen assembly and enclosure are more rigid and stable. Additionally, the bent segments also slightly enlarge the playpen enclosure zone.

The enclosure assembly 14 may preferably be washable and, as by now is apparent, is therefore removeable and replaceable upon the frame assembly 12. To remove the enclosure 14 from the frame assembly, it is necessary only to detach the anchoring loops 190, and hooks 204B, if they are present, after tension has been released from the enclosure. The release feet 134 may then be released as described above, to release the tension in the sidewalls 16 permitting the legs 20 to partially collapse. Thereafter the enclosure 14 may there simply be lifted off the legs 20 and washed or cleaned.

To replace the enclosure upon the frame assembly, the steps need only be reversed. To that end, the enclosure 14 is brought to the frame assembly, and a protective cover portion 174, back panel 164 and protective panel portion 163 of the protective panel 162, as well as the strap loops 186, are juxtaposed with each of the legs 20 in the manner described. Thus, with the frame assembly semi-erect, the outer and inner loops 190 are separated, are gripped and are pulled downwardly along the leg to fully position a leg within the pocket assembly formed by panels 162, 164 and cover 174. When so assembled, the sidewall assembly circumscribes the upstanding legs 20 placing the legs within the enclosure 14. Thereafter the anchoring loops 190 and skirt hooks 204B, if any, are reattached. A child is protected from engagement with the legs by the inner protective panel 163.

It will thus be apparent that a highly effective portable foldable playpen is made available in accordance with the present invention. The fabric enclosure and frame assembly are readily assembleable and disassembleable from each other. The frame assembly, while mounting the fabric enclosure, is readily, easily and quickly foldable from a fully set-up position, to one which is very compact and easily transportable, but yet is ready for quick and easy setting up for use by a small child.

A typical playpen assembly as illustrated in FIGS. 1 and 2 may have legs 20 about 33 inches long, with the lower segment 22 being about 10 inches long and the outwardly bent upper segment 24 being bent at an angle of about five degrees to the lower segment 22. The angle may vary depending upon the tension desired, the dimensions of the playpen, etc. The width of the frame assembly between opposite legs may be about 46 inches, with the protective panel 163 being spaced inwardly of the legs 20 about 1 inch. Desirably a foam layer or the like may be interposed between the panel 163 and the leg 20 to cushion a child from falls, although such should not be necessary if the protective panel is sufficiently taut. Although the dimensions listed are typically useful for a hexagonal playpen as described herein, other dimensions may be used as well, and indeed the playpen may be miniaturized for use as a toy as well.

It will be apparent to those skilled in the art that other modifications beyond the several embodiments disclosed may be made without departing from the spirit and scope of the present invention. Accordingly, we do not intend the invention to be considered as being limited except insofar as made necessary in accordance with the appended claims.

What is claimed is:

1. A portable foldable playpen assembly comprising a foldable frame assembly and an enclosure, said foldable frame assembly comprising a central hub, at least four support legs spaced outwardly of said hub, and a plurality of linkage means each being hingedly connected at one end to said central hub and at the other end to said legs, said linkage means being adapted to maintain said legs in a first expanded spaced array in which they are upright and generally parallel and widely spaced from the central hub and to permit movement of said legs into a second contracted compact array in which said legs are much closer to the central hub and to each other for transport, and means on said enclosure for securing said enclosure to said support legs, and wherein said linkage means are positioned beneath said enclosure, and each said linkage means includes an arm hingedly connected to a leg and to said central hub and for permitting movement of said legs into said compact array with said legs being generally in an upright parallel compact array, and wherein each said linkage means further includes a link connecting a said arm to a said leg at a location spaced from the location at which said arm is connected to said leg, and which link is moveable along said leg.

2. A portable foldable playpen assembly in accordance with claim 1, and wherein said linkage means includes releasable lock means for locking said support legs to said linkage means in said widely spaced array and for permitting said support legs to be unlocked for movement of said legs into said contracted compact array.

3. A portable foldable playpen assembly in accordance with claim 2, and wherein said linkage means are positioned beneath said enclosure, and said linkage means includes an arm hingedly connected to each leg and to said central hub and for permitting movement of said legs into said compact array with said legs being generally in an upright parallel compact array.

4. A portable foldable playpen assembly in accordance with claim 1, and wherein said enclosure comprises a sidewall and a floor, and said securing means comprises pocket means on said enclosure for removeably securing said enclosure to said frame assembly.

5. A portable foldable playpen assembly in accordance with claim 4, and wherein each said leg has an upper end and a foot and said enclosure floor is spaced well above said feet and above said linkage means, and skirt means depending from said sidewall to enclose the space between said floor and said feet, thereby to prevent entry beneath said enclosure floor when said playpen assembly is in use.

6. A foldable playpen in accordance with claim 4, and wherein said pocket means are formed within the enclosure.

7. A portable foldable playpen assembly in accordance with claim 1, and further comprising pivot means hingedly connecting a said linkage means to said central hub and to a said leg, and wherein said linkage means defines a bearing surface at each end and wherein said central hub and said leg each define a bearing surface confronting a said end, so that when said playpen is in said expanded spaced array, said linkage means bears against said confronting bearing surface rather than against said pivot means.

8. A portable collapsible playpen assembly comprising a frame assembly and a fabric enclosure, said frame assembly comprising at lesat four generally vertically disposed support legs, means for retaining said support legs in a predetermined spaced array, said support legs having upper ends and foot portions for supporting the legs on a support surface, said enclosure comprising a sidewall and a floor and pocket means for suspendind said enclosure on the upper ends of said legs with said floor spaced well above said foot portions, and skirt means depending from said floor between said floor and said foot portions for preventing entry below said enclosure when said foot portions are supported on a support surface, to positively prevent access below said frame assembly by a small child when the playpen assembly is floor supported, and wherein said skirt means comprise skirt panels secured to said sidewall, and fastening means, and said skirt means being removably secured to said legs with said fastening means adjacent said foot portions.

9. A portable collapsible playpen assembly in accordance with claim 8, and wherein said pocket means are formed within the enclosure.

10. A portable foldable playpen assembly comprising a foldable frame assembly and an enclosure, said foldable frame assembly comprising a central hub, at least four support legs spaced outwardly of said hub, and a plurality of linkage means, each hingedly connected at one end to said central hub and at the other end to said legs, said linkage means being adapted to maintain said legs in a first expanded spaced array in whioh they are upright and generally parallel and widely spaced from the central hub and to permit movement of said legs into a second contracted compact array in which said legs are much closer to the central hub and to each other for transport, means on said enclosure for securing said enclosure to said support legs, said linkage means including releasable lock means for locking said support legs in said widely spaced array and for permitting said support legs to be unlocked for movement of said legs into said contracted compact array, and wherein said linkage means are positioned beneath said enclosure, and said linkage means further including an arm hingedly connected to each leg and to said central hub and for permitting movement of said legs into said compact array with said legs being generally in an upright parallel compact array, said linkage means further including links hingedly connecting a said arm to a said leg and which slide along said leg.

11. A portable foldable playpen assembly in accordance with claim 10, and further including a slide on said leg, and wherein a said link is hingedly connected to said slide, and locking means on said slide for releasably locking said support legs in said widely spaced, upright array and for permitting said support legs to be unlocked for movement of said legs into said contracted compact array.

12. A portable foldable playpen assembly in accordance with claim 11, and wherein said support legs have feet, and means on said feet for releasably engaging said locking means for locking said support legs in said widely spaced upright array.

13. A portable foldable playpen assembly in accordance with claim 12, and wherein said linkage means include a hinge fixedly secured to each leg connecting said arm to said leg, and wherein said slide is slideable between a said foot and a said hinge along a said leg.

14. A portable foldable playpen assembly comprising a foldable frame assembly and an enclosure, said foldable frame assembly comprising a central hub, at least four support legs spaced outwardly of said hub, and a plurality of linkage means each hingedly connected at one end to said central hub and at the other end to said legs, said linkage means being adapted to maintain said legs in a first expanded spaced array in which they are upright and generally parallel and widely spaced from the central hub and to permit movement of said legs into a second contracted compact array in which said legs are much closer to the central hub and to each other for transport, and means on said enclosure for securing said enclosure to said support legs, and wherein said central hub defines a central hub section defining a plurality of sockets, a removeable hub wedge in each socket, and wherein each said linkage means is hingedly connected at one end to a said removeable hub wedge, and pivot means hingedly connecting a said removeable hub wedge and a said linkage means to said hub section.

15. A portable foldable playpen assembly in accordance with claim 14, and wherein said pivot means is removeable and connects said hub wedge and linkage means to said hub section for pivotal movement relative thereto.

16. A portable, foldable playpen assembly in accordance with claim 15, and wherein said linkage means are positioned beneath said enclosure, and said linkage means includes an arm hingedly connected to each leg and to said removeable hub wedge and for permitting movement of said legs into said compact array with said legs being generally in an upright parallel compact array.

17. A portable foldable playpen assembly in accordance with claim 14, and wherein each said linkage means defines a bearing surface and said hub wedge defines a confronting bearing surface so that when said playpen is in said expanded spaced array, said linkage means bears against said hub wedge rather than against said pivot means.

* * * * *

UNITED STATES PATENT AND TRADEMARK OFFICE

CERTIFICATE OF CORRECTION

PATENT NO. : 4,739,527

DATED : April 26, 1988

INVENTOR(S) : Louis M. Kohus; Eugene L. Timperman

It is certified that error appears in the above-identified patent and that said Letters Patent is hereby corrected as shown below:

| | |
|---|---|
| Col. 3, line 18 | After "section;" delete "," |
| Col. 11, line 26 | "lesat" should be instead -- least -- |
| Col. 11, line 32 | "suspendind" should be instead -- suspending -- |
| Col. 12, line 54 | After "portable" delete "," |

Signed and Sealed this

Fourth Day of April, 1989

*Attest:*

*Attesting Officer*

DONALD J. QUIGG

*Commissioner of Patents and Trademarks*